US007824235B2

(12) United States Patent
Yang

(10) Patent No.: US 7,824,235 B2
(45) Date of Patent: Nov. 2, 2010

(54) CONDUCTING TERMINAL CONNECTOR AND MANUFACTURING METHOD THEREOF

(75) Inventor: Chun-Wei Yang, Hsien-Shi Township, Chang-Hwa County (TW)

(73) Assignee: K.S. Terminals Inc., Chang-Hwa County (TW)

( * ) Notice: Subject to any disclaimer, the term of this patent is extended or adjusted under 35 U.S.C. 154(b) by 92 days.

(21) Appl. No.: 12/420,083

(22) Filed: Apr. 8, 2009

(65) Prior Publication Data

US 2009/0191770 A1 Jul. 30, 2009

Related U.S. Application Data

(63) Continuation-in-part of application No. 11/878,395, filed on Jul. 24, 2007, now abandoned.

(51) Int. Cl.
*H01R 4/02* (2006.01)

(52) U.S. Cl. ..... 439/874; 439/275; 439/415; 174/84 R; 174/87

(58) Field of Classification Search ..... 439/275, 439/874, 415; 174/84 R, 87
See application file for complete search history.

(56) References Cited

U.S. PATENT DOCUMENTS 2,655,641 A * 10/1953 Asaff ..... 439/874
4,586,971 A * 5/1986 Wallace, Jr. ..... 156/85
4,595,724 A * 6/1986 Koblitz ..... 524/409
4,883,925 A 11/1989 Graf
5,137,478 A 8/1992 Graf et al.
5,887,779 A 3/1999 Fehlhaber
5,975,939 A * 11/1999 Market ..... 439/415
6,666,732 B1 12/2003 Endacott
7,048,562 B2 * 5/2006 Lutsch et al. ..... 439/275
7,448,922 B1 * 11/2008 Chan ..... 439/874

* cited by examiner

*Primary Examiner*—Truc T Nguyen
(74) *Attorney, Agent, or Firm*—Ming Chow; Sinorica, LLC

(57) ABSTRACT

There is disclosed a conducting terminal connector which comprises an insulating tube, a conducting terminal and a soldering sleeve. The conducting terminal has a first end received in the insulating tube and a second end opposite to said first end, and the second end is exposed outwardly for connecting an external conducting contact point so that the first end is bent to form a longitudinal elongation with an opening facing upward. The soldering sleeve is formed by a casting method so as to form a corrugated surface on the outer periphery thereof, and has a melting point in which a heat source is applied to an outer part of the insulating tube so that an inner part of the insulating tube is shrunken to lodge in the outer corrugated surface of the soldering sleeve thereby forming the conducting terminal connect.

16 Claims, 11 Drawing Sheets

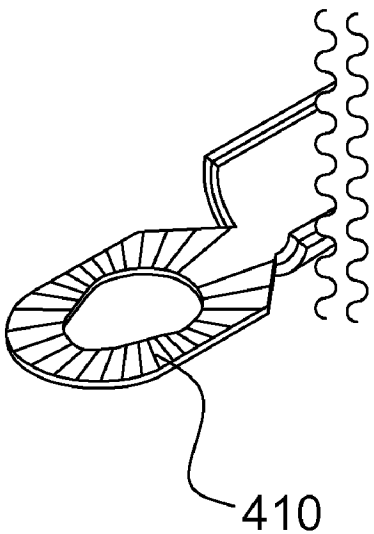
Fig.4C
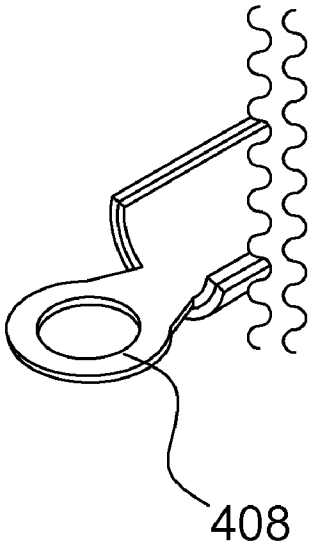
Fig.4B
Fig.4A

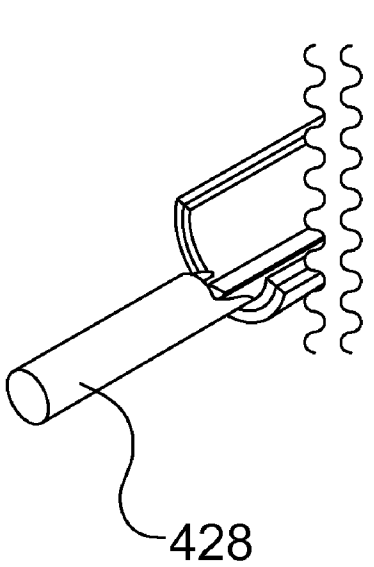
Fig.4L
Fig.4K
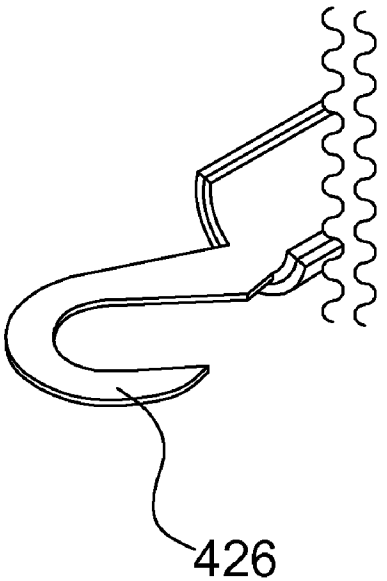
Fig.4J

CONDUCTING TERMINAL CONNECTOR AND MANUFACTURING METHOD THEREOF

This application is a continuation-in-part of U.S. patent application Ser. No. 11/878,395, dated Jul. 24, 2007 now abandoned.

BACKGROUND OF THE INVENTION

1. Field of the Invention

The present invention relates to a conducting terminal connector and a method of fabricating the same, and more particularly, to a conducting terminal connector that employs an insulating tube and a soldering sleeve as a joining device for joining a conducting terminal and a conducting wire.

2. Description of the Related Art

In a conventional method of joining two conducting wires, an insulating adhesive tape is used to wind around conducting cores of the conducting wires that are exposed outwardly of insulating claddings of the conducting wires, in order to cause the conducting cores to connect with each other, thereby achieving electrical conduction therebetween. However, due to the use of adhesive tape, the conducting wires may be easily affected by environmental factors, which cause electric leakage or problems related to dampness. In response to these problems, U.S. Pat. No. 4,883,925 proposed a conducting wire connecting device 100. Referring to FIG. 1A, the connecting device 100 includes an insulating tube 102 with an adhesive coating 106 on an inner surface thereof. A solder sleeve 104 with smooth outer and inner surfaces is disposed in the insulating tube 102. The outer surface of the solder sleeve 104 is connected to the inner surface of the insulating tube 102 by the adhesive coating 106. An external heater is then used to melt the solder sleeve 104 in order to join the conducting cores of the two conducting wires. The insulating tube 102 is then heated and shrunken to fix the conducting wires, thereby achieving the connection of the conducting wire and electrical conduction. However, forming the adhesive coating 106 on the inner surface of the insulating tube 102 of the connecting device 100 leads to high production cost, and it can be difficult to dispose the solder sleeve 104 into the insulating tube 102 after the formation of the adhesive coating 106.

Referring to FIG. 1B, U.S. Pat. No. 5,137,478 proposed a conducting terminal connector with solder material. The conducting terminal includes a semicircular end portion 108. A solder material 110 is coated on an inside of the semicircular end portion 108 for connecting with a conducting core.

Referring to FIG. 1C, U.S. Pat. No. 6,666,732 proposed another conducting terminal connector with solder material. The conducting terminal includes a round tubular end portion 112. The round tubular end portion 112 includes a solder sleeve 114 for connecting with a conducting core. The above-mentioned prior art technologies still have some disadvantages in practice and thus need to be improved.

Referring to FIG. 1D, U.S. Pat. No. 5,887,779 proposed another conducting terminal connector with solder coil 14 inside. The solder coil 14 with lots of winding circles is wound. There exists a seam between every two adjacent winding circles. These seams weaken the stiffness of the solder coil and make the solder coil flexible. It is not easy to put and locate the solder coil 14 at the right position in the tubular member 12. The manufacturing of conducting terminal connector is difficult.

BRIEF SUMMARY OF THE INVENTION

To address the problems in the prior art, the present invention provides a conducting terminal connector and a method for fabricating the same. The conducting terminal connector comprises a conducting terminal, an insulating tube and a soldering sleeve, for joining the conducting terminal and a conducing wire. The conducting wire includes a conducting core and an insulating cladding enclosing the conducting core. The insulating tube is shrunken and deformed when heated to a temperature higher than a first temperature, and has a melting point at a second temperature. The conducting terminal includes a first end accommodated in the insulating tube, and a second end opposite to the first end and exposed outwardly for connecting to an external conducting contact point. The first end is bent to form a longitudinal elongation with an opening facing upward. The soldering sleeve is made by a casting method so as to form a corrugated and seamless outer surface on an outer periphery of the soldering sleeve. The soldering sleeve has a melting point at a third temperature between the first temperature and the second temperature. The soldering sleeve is placed on the longitudinal elongation of the conducing terminal so as to allow insertion of the conducting core with the stripped-off insulating cladding. When heating an outer part of the insulating tube that corresponds to the soldering sleeve to heat the insulating tube to a predetermined temperature between the first temperature and the third temperature, an inner part of the insulating tube that corresponds to the soldering sleeve is shrunken to lodge in the outer corrugated surface of the soldering sleeve, thereby forming the conducting terminal connector.

Therefore, a principal object of the present invention is to provide a conducting terminal connector having a conducting terminal, a soldering sleeve and an insulating tube, wherein the soldering sleeve has a corrugated and seamless outer surface formed on its outer periphery by a casting method, thereby to obtain better connection between the soldering sleeve and the insulating tube because an inner part of the insulating tube is shrunken to lodge in the corrugated and seamless outer surface of the soldering sleeve when heating an outer part of the insulating tube.

Another object of the present invention is to provide a conducting terminal connector having a conducting terminal, a soldering sleeve and an insulating tube, wherein the soldering sleeve is formed to be seamless by a casting method so as to have better strength and stiffness. It is easier to place the soldering sleeve in the insulating tube. The manufacturing method of the conducting terminal connector is also easier.

Another object of the present invention is to provide a conducting terminal connector having a conducting terminal, a soldering sleeve and an insulating tube, wherein the soldering sleeve having a corrugated and seamless outer surface corrugated surface formed on its outer periphery by a casting method. Therefore, the conducting terminal connector has better structure strength.

Another object of the present invention is to provide a manufacturing method of a conducting terminal connector having a conducting terminal, a soldering sleeve and an insulating tube, wherein the soldering sleeve is formed by a casting method to have a corrugated and seamless outer surface on its outer periphery, thereby to achieve better connection between the soldering sleeve and the insulating tube because an inner part of the insulating tube is formed to be shrunken to lodge in the corrugated and seamless outer surface of the soldering sleeve when heating an outer part of the insulating tube.

Another object of the present invention is to provide a manufacturing method of a conducting terminal connector having a conducting terminal, a soldering sleeve and an insulating tube, which allows the soldering sleeve and the insulating tube to be assembled easily.

Another object of the present invention is to provide a manufacturing method of a conducting terminal connector having a conducting terminal, a soldering sleeve and an insulating tube, in which the soldering sleeve and the insulating tube consolidate to form a conducting structure with better structure strength.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein:

FIG. 4A through 4L show schematic views of preferred embodiments of the conducting terminal in accordance with the present invention.

DETAILED DESCRIPTION OF THE INVENTION

The present invention discloses a structure of a conducting terminal connector and a manufacturing method of the same. The principle in the connector fabrication and electrical conduction has been disclosed in details in the related art section; therefore, the manner that the conducting wire is connected to the conducting core will not be described in further details in the following description. Also, the drawings referred to in the following description are not made according to actual dimensions and are merely schematic views showing features of the present invention. The following description is of the best-contemplated mode of carrying out the invention. This description is made for the purpose of illustrating the general principles of the invention and should not be taken in a limiting sense. The scope of the invention is best determined by reference to the appended claims. Moreover, the figures included in the following are not completely drawn according to the real size and are only used to demonstrate features related to the present invention.

Figure 1A:
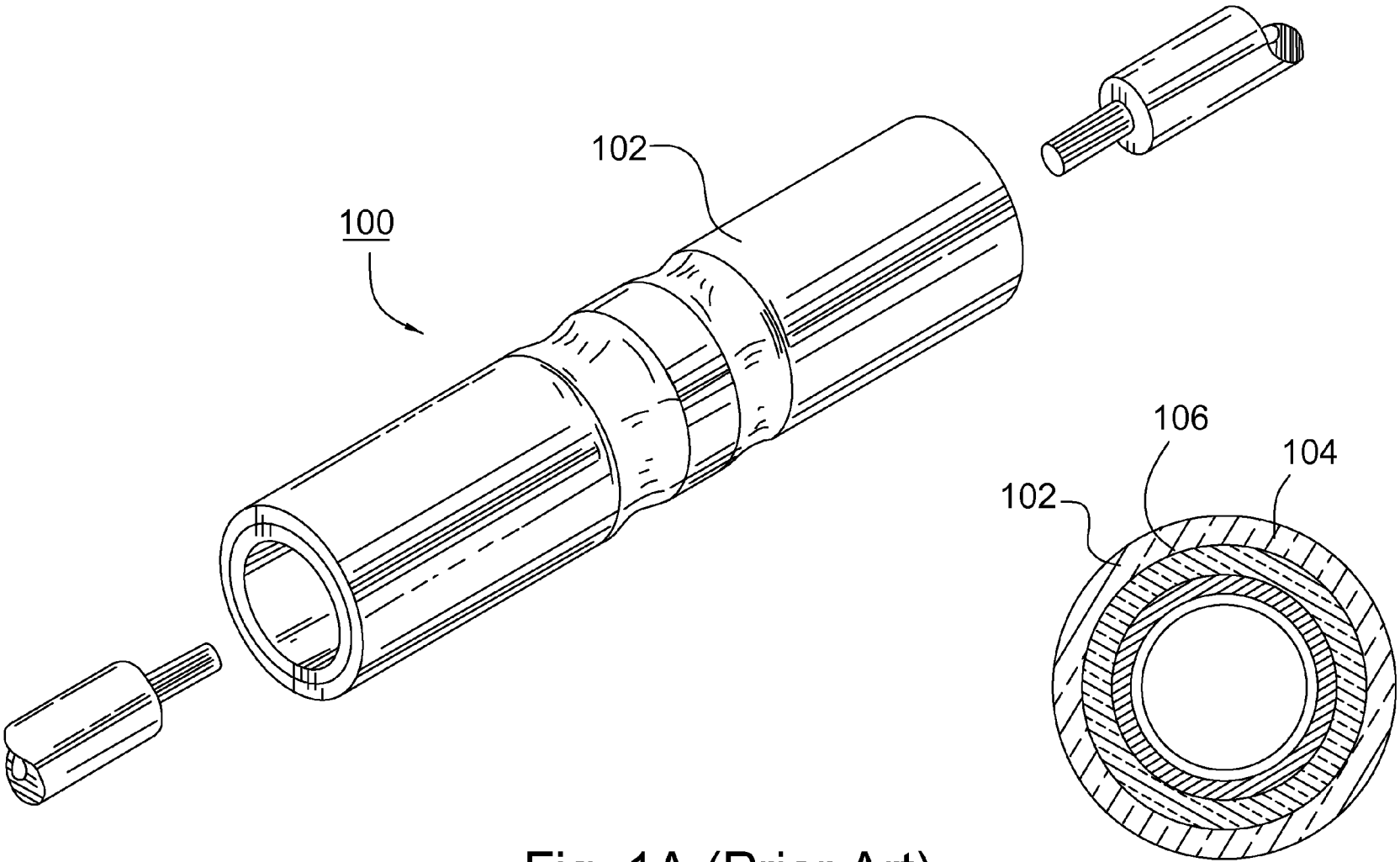
Fig. 1A (Prior Art)
FIGS. 1A, 1B, 1C and 1D show conventional conducting terminal connectors.
Figure 1B:
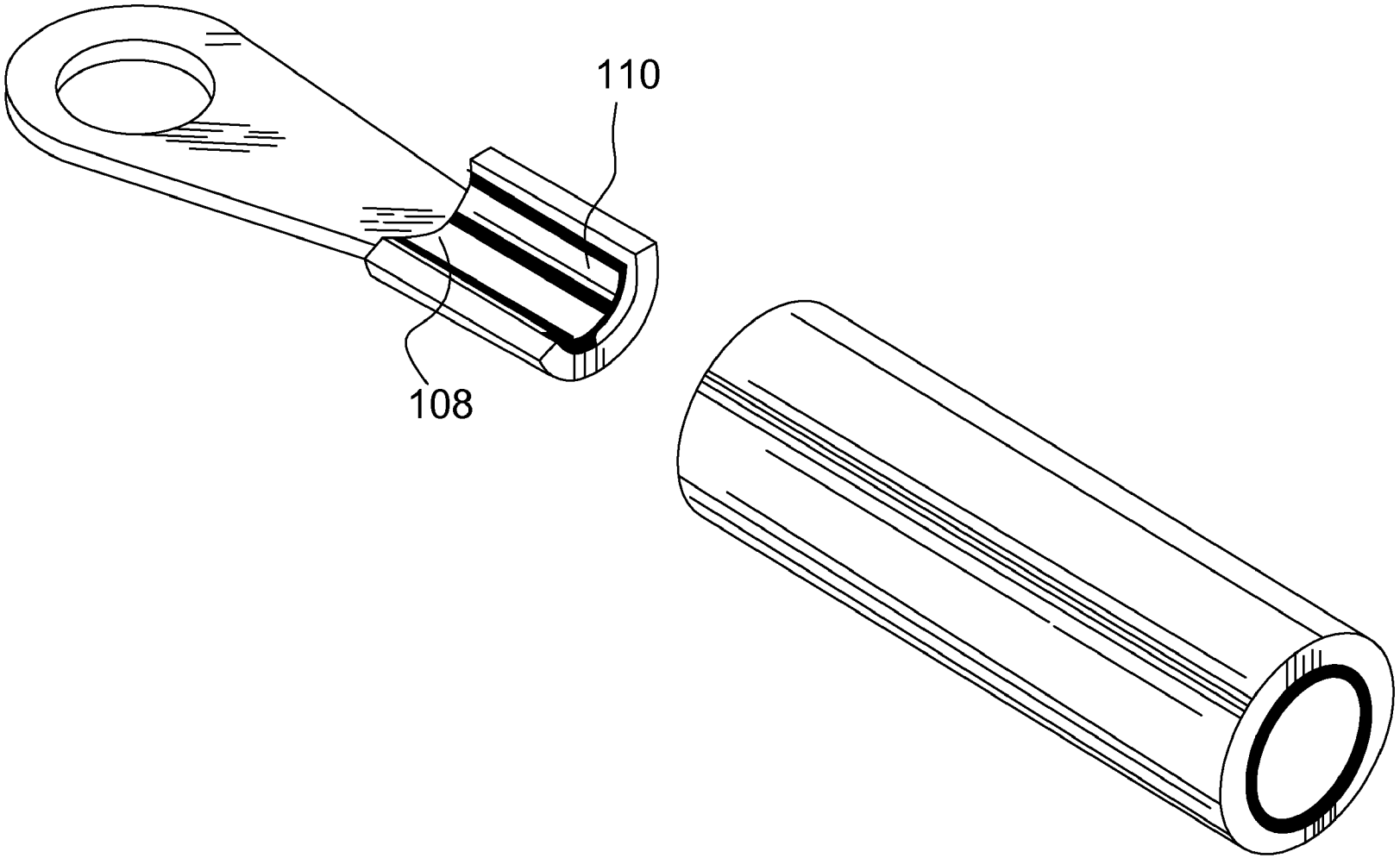
Fig.1B(Prior Art)
Figure 1C:
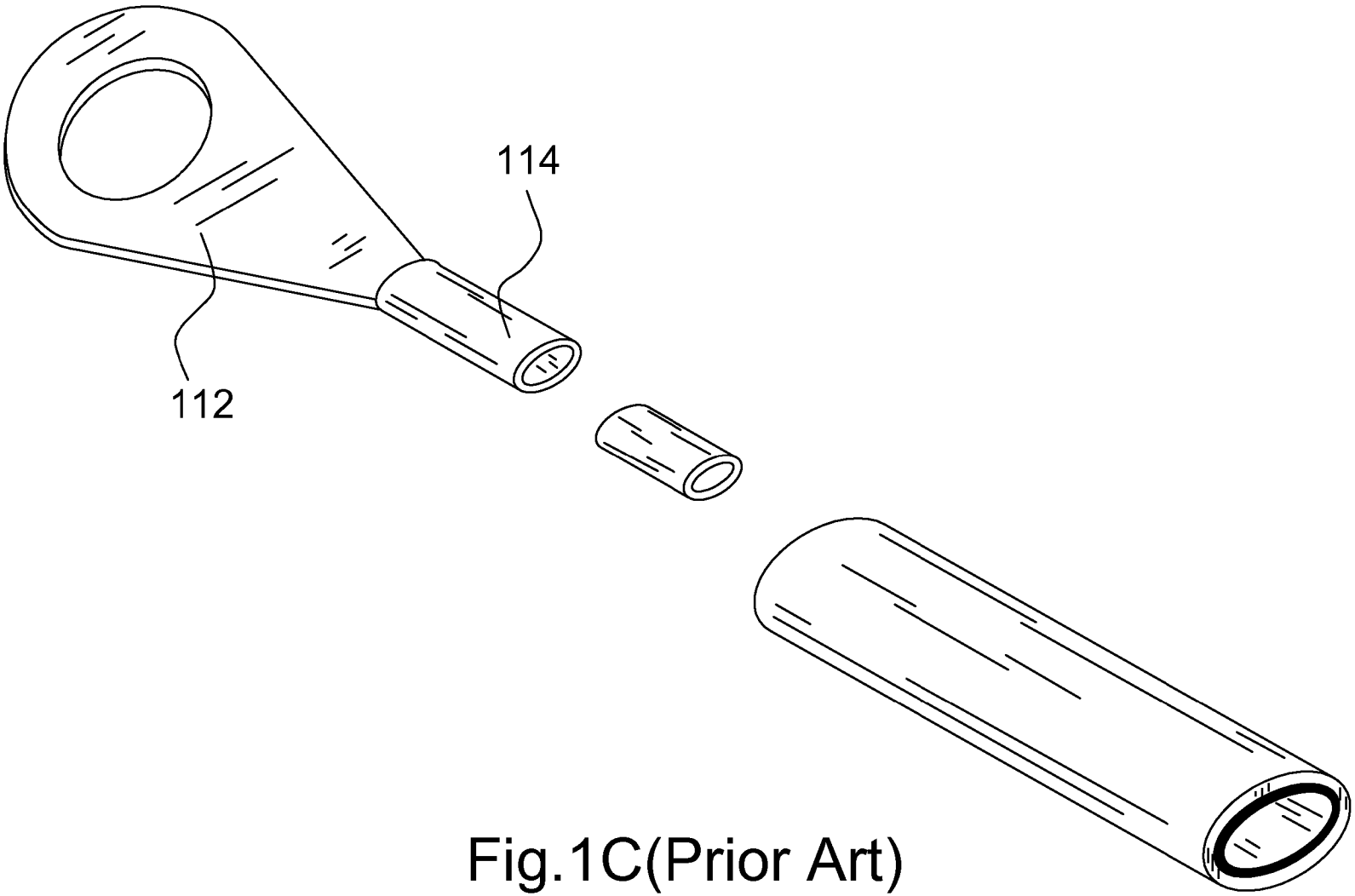
Fig.1C(Prior Art)
Figure 1D:
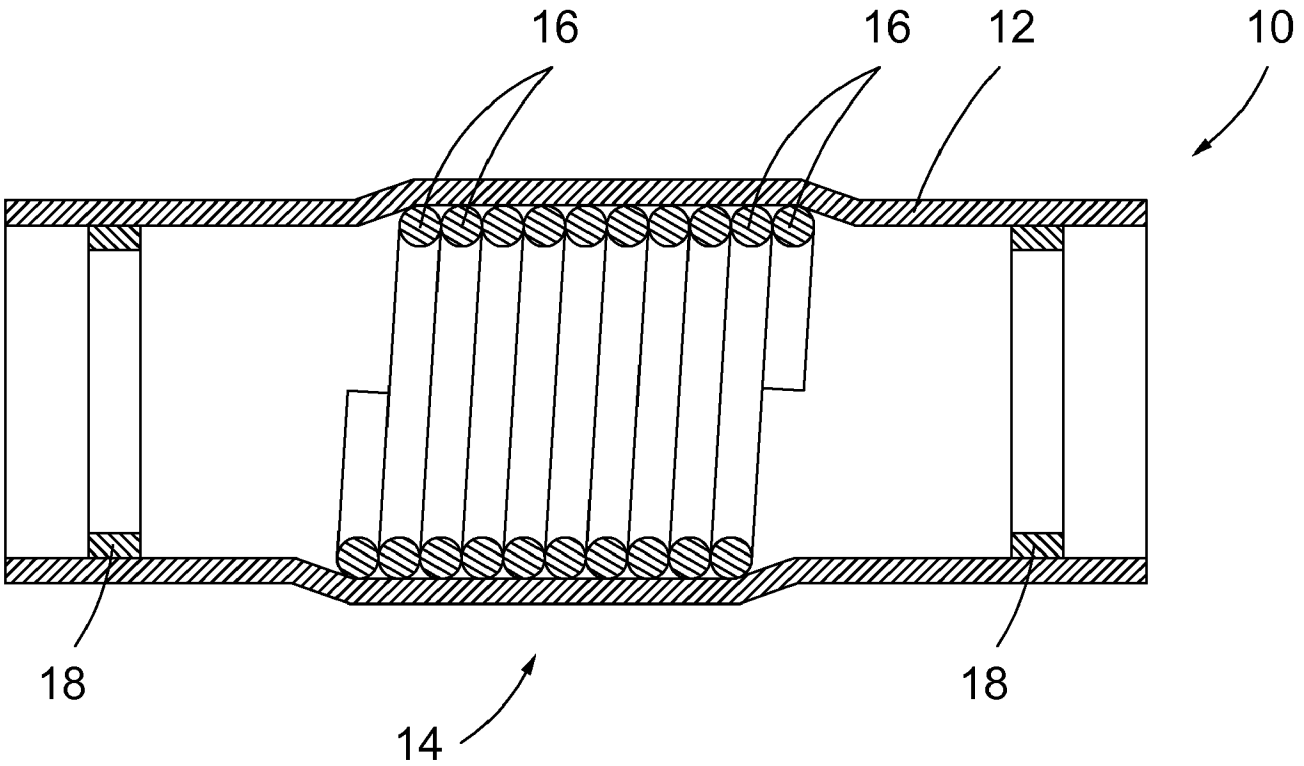
FIG. 1D (Prior Art)
Figure 2:
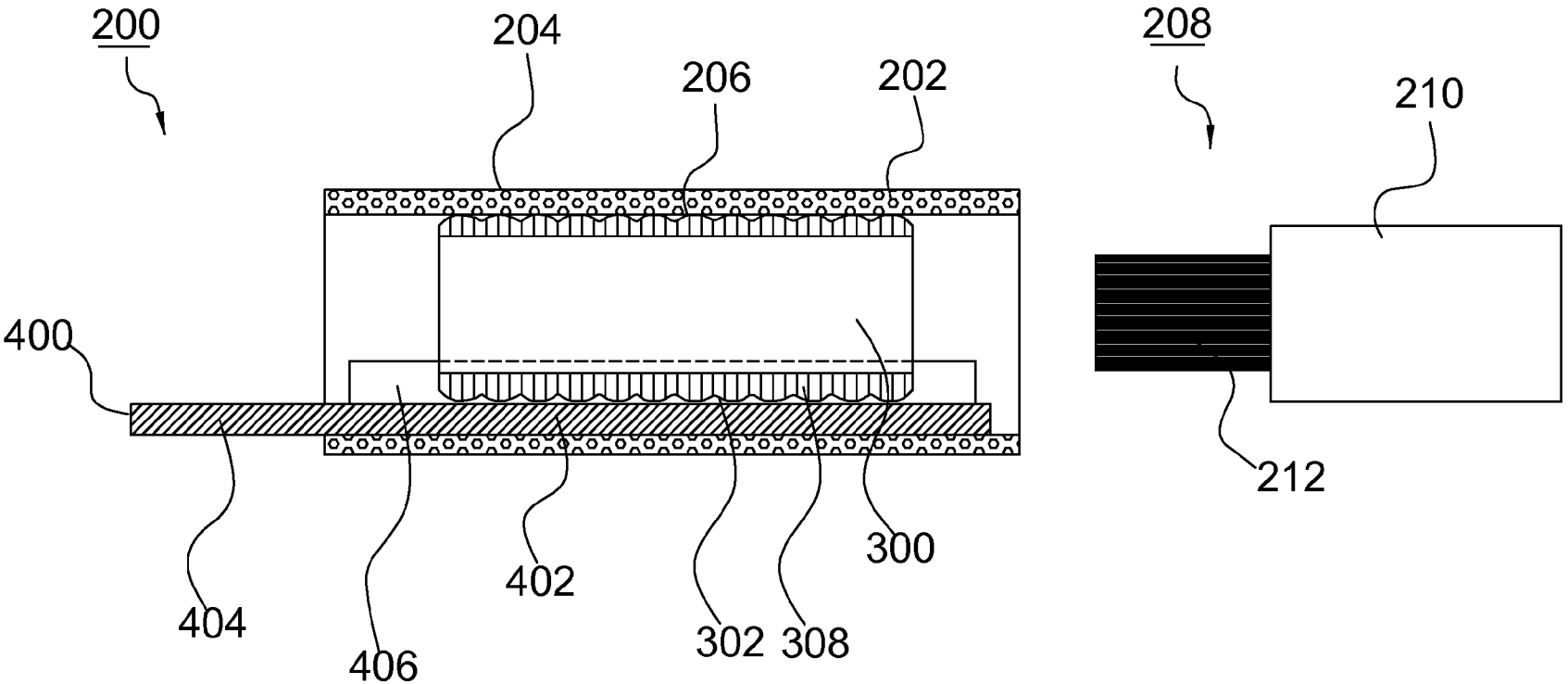
FIG. 2 is a schematic view of a conducting terminal connector in accordance with the present invention.

Refer to FIG. 2, which is a schematic side view of a conducting terminal connector in accordance with the present invention. The conducting terminal connector 200 comprises an insulating tube 202 and a soldering sleeve 300 for joining a conducting terminal 400 and a conducting wire 208. The insulating tube 202 is shrunken and deformed due to its own material characteristic when it is heated to a temperature higher than a first temperature and has a melting point at a second temperature. The conducting terminal 400 includes a first end 402 accommodated in the insulating tube 202, and a second end 404 opposite to the first end 402. The second end 404 is less than the insulating tube 202 in length and is exposed outwardly, for connecting to an external conducting contact point. The first end 402 is bent to form a longitudinal elongation 406 with an opening facing upward. The longitudinal elongation 406 of the conducting terminal 400 is semicircular or C-shaped adaptive to receive the soldering sleeve 300. In addition, the material of the soldering sleeve 300 may comprise a material such as brass, bronze, copper alloy, gold, karat gold, tin, lead, nickel, silver or bismuth. The soldering sleeve 300 is formed by a casting method to forming a corrugated and seamless outer surface on an outer periphery of the soldering sleeve 300. In addition, the material of the conducting terminal 400 may comprise a material such as brass, bronze, copper alloy, stainless steel, gold, karat gold alloy and platinum. The conducting wire 208 includes a conducting core 212 and an insulating cladding 210 enclosing the conducting core 212.

The soldering sleeve 300 is firstly placed on the longitudinal elongation 406 of the conducting terminal 400, and the soldering sleeve 300 is a hollow structure with a corrugated and seamless outer surface (i.e. reference number 308 shown in FIG. 3A) formed by the casting method so as to allow insertion of the conducting core 212 of the strip-off insulating cladding 210, and thus the conducting terminal 400 together with the soldering sleeve 300 disposed on the longitudinal elongation 406 are placed in the insulating tube 202. The soldering sleeve 300 has a melting point at a third temperature between the first temperature and the second temperature. Whatever shapes the soldering sleeve 300 can be made of. Please referred to FIG. 3A, the corrugated surface 308 of the soldering sleeve 304 can be wave-like or serrate based on its casting method, wherein the height of the waves can be identical or different, and the distance between the waves can also be the identical or different; the height of the serrations can be identical or different and the distance between the serrations can be identical or different as well.

Figure 3B:
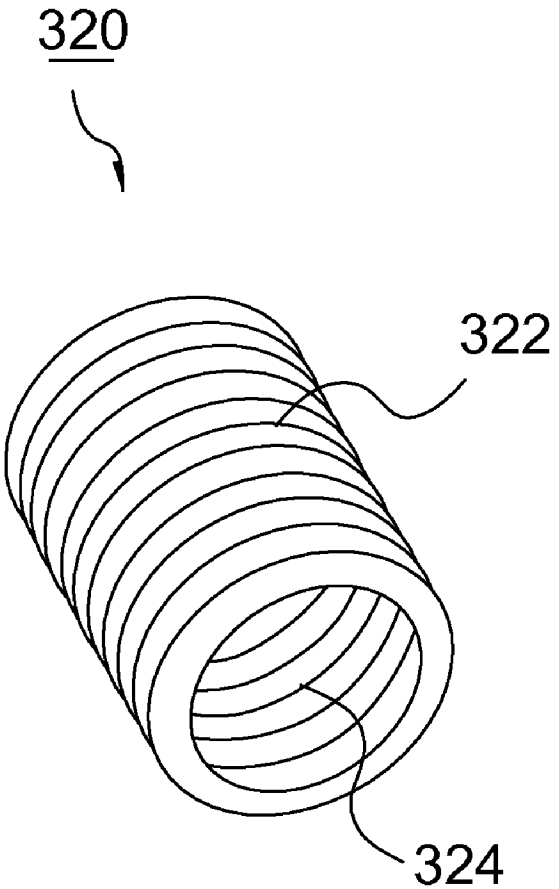
FIG. 3A and FIG. 3B show schematic views of preferred embodiments of the soldering sleeve in accordance with the present invention.
Figure 3A:
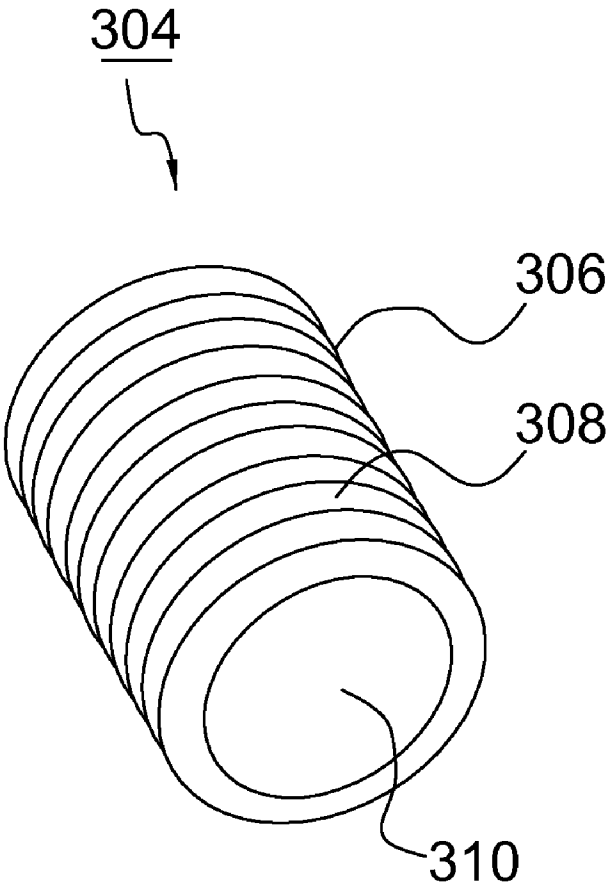

FIG. 3A also shows a preferred embodiment of the soldering sleeve 300. The soldering sleeve 304 has an outer periphery 306 with a corrugated and seamless outer surface 308 formed by a casting method, and an inner periphery with a smooth surface 310 formed thereon, allowing insertion of the conducting core 212 of the strip-off insulating cladding 210. When heating an outer part 204 of the insulating tube 202 that corresponds to the soldering sleeve 304 to heat the insulating tube 202 to a temperature between the first temperature and the third temperature, an inner part 206 of the insulating tube 202 that corresponds to the soldering sleeve 304 shrinks to lodge into corrugated gaps 302 of the corrugated and seamless outer surface 308 of the soldering sleeve 304, thereby fixedly joining the insulating tube 202 and the soldering sleeve 304 to form the conducting terminal connector 200, thus achieving a more reliable connection between the soldering sleeve 304 and the insulating tube 202, so that they cannot be disconnected easily. In joining the connecting terminal 400 and the conducting wire 208, the conducting core 212 with the insulating cladding 210 stripped off is inserted into the conducting terminal connector 200, and a heat source is applied in order to heat the soldering sleeve 304 to the melting point of the third temperature. Therefore, the soldering sleeve 304 in the conducting terminal connector 200 melts and consolidates with the conducting core 212 to form a conducting structure with good structure strength.

FIG. 3B shows another preferred embodiment of the soldering sleeve 300. The soldering sleeve 330 further comprises an extension 332 over the longitudinal elongation 406 of the conducting terminal 400. The extension 332 is provided with a radial enlargement 334 for better insertion of the conducting core 212.

Figure 3C:
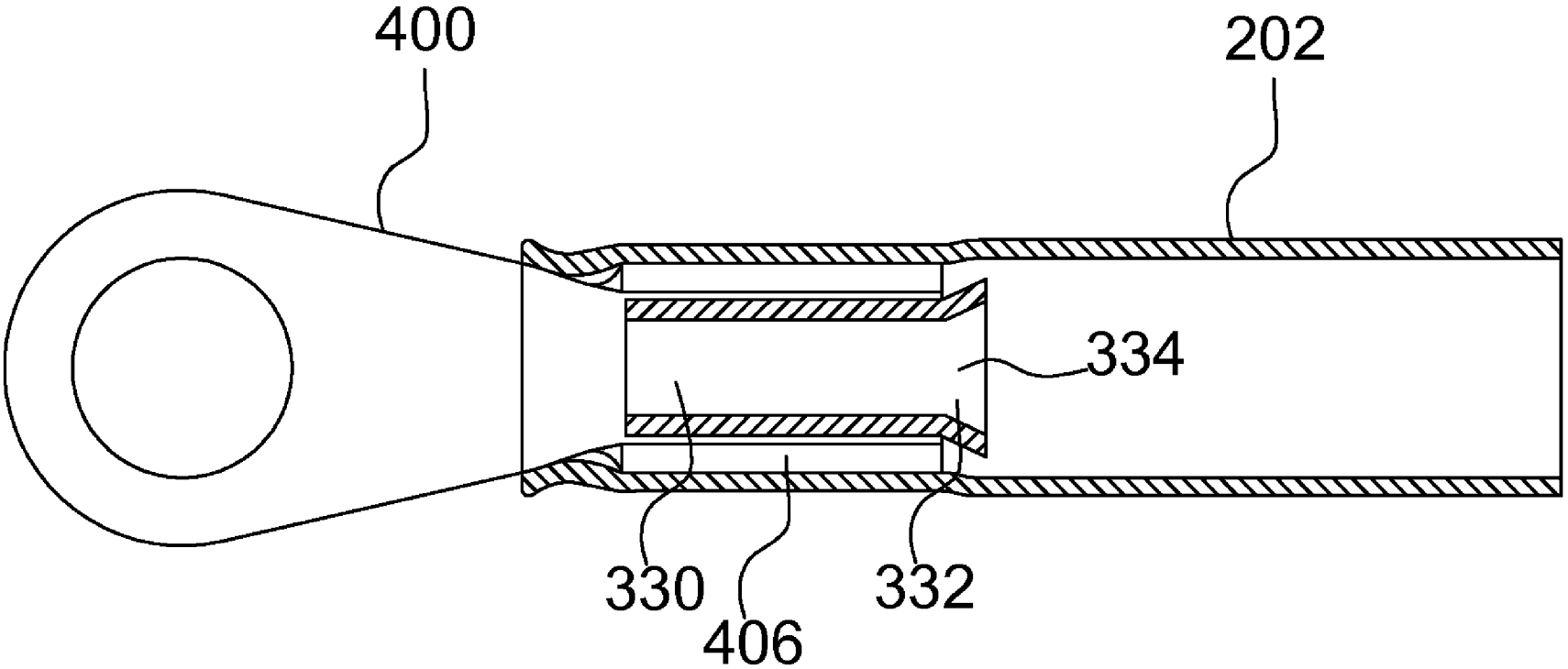
FIG. 3C show schematic views of another preferred embodiments of the soldering sleeve in accordance with the present invention.

FIG. 3C shows another preferred embodiment of the soldering sleeve 300. The soldering sleeve 320 includes a corrugated and seamless outer surface 322 and a corrugated and seamless inner surface 324. The measure of area of corrugated surface is increased; the soldering sleeve 320 and the insulating tube 202, or the soldering sleeve 320 and the conducting core 212 consolidate to form a conducting structure with better structure strength.

Figure 4E:
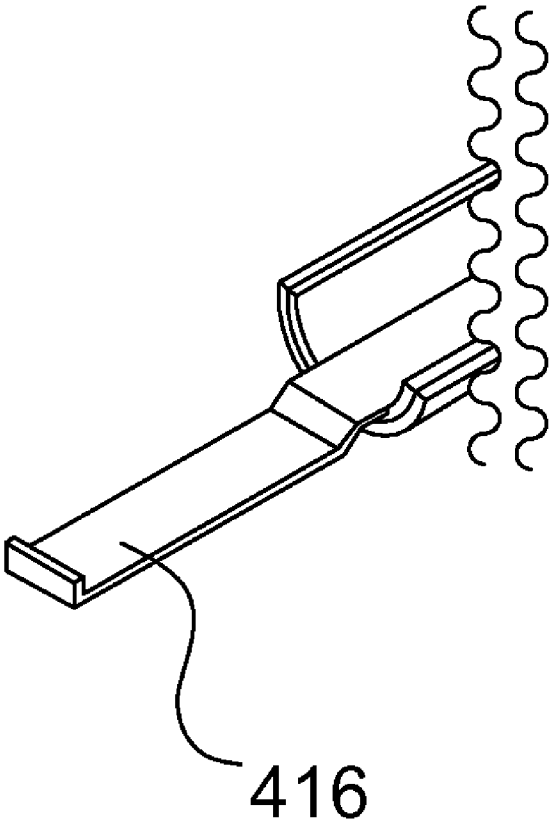
Figure 4D:
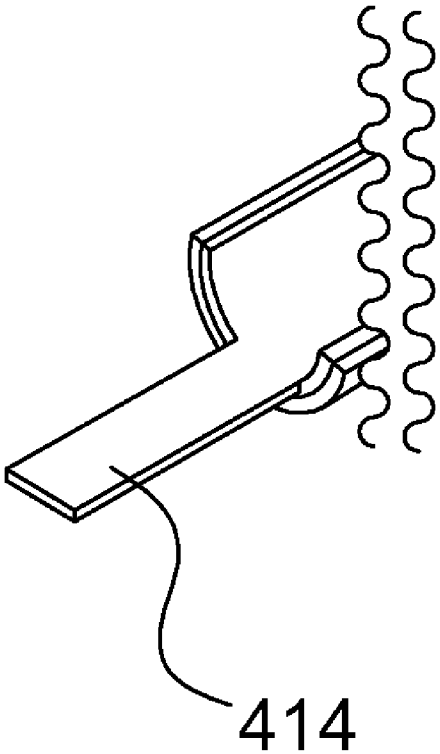
Figure 4I:
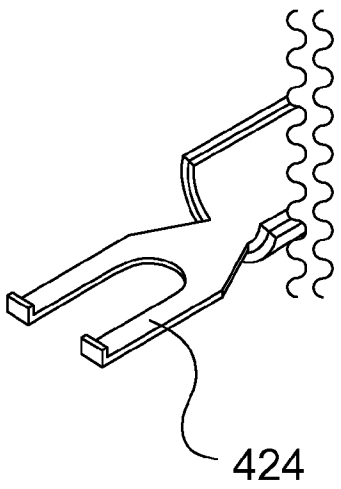
Figure 4H:
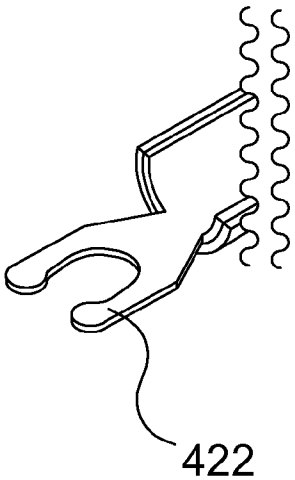
Figure 4G:
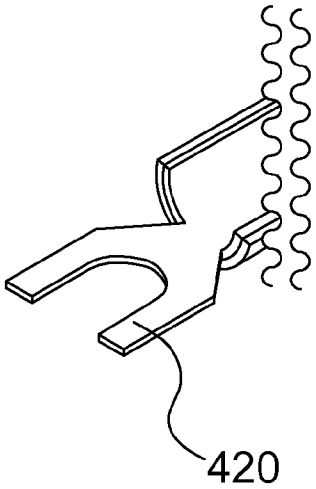
Figure 4F:
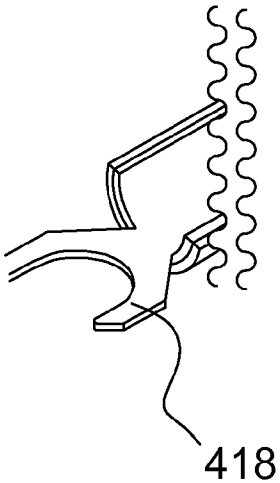

FIG. 4A and FIG. 4B show preferred embodiments of the conducting terminal 400, wherein the second end 404 of the conducting terminal 400 forms a ring terminal 408 or a multiple-stud ring terminal 410 that is disk-shaped and has a central opening. FIG. 4C shows another embodiment of the conducting terminal 400, wherein the second end 404 of the conducting terminal 400 forms a serrated ring terminal 412 that is disk-shaped and has a central opening with serrations extending into the opening. FIG. 4D shows another preferred embodiment of the conducting terminal 400, wherein the second end 404 of the conducting terminal 400 forms a blade terminal 414 that is an elongated blade in shape. FIG. 4E shows another embodiment of the conducting terminal 400, wherein the second end 404 of the conducting terminal 400 forms a lipped blade terminal 416 that is an elongated blade in shape and has a bent portion formed at a distal end thereof. FIG. 4F, FIG. 4G, FIG. 4H show other preferred embodiments of the conducting terminal 400, wherein the second end 404 of the conducting terminal 400 forms Y-shaped fork terminal 418, spade terminal 420 or locking spade terminal 422 that is a blade in shape and has an opening formed at a front edge thereof. FIG. 4I shows another preferred embodiment of the conducting terminal 400, wherein the second end 404 of the conducting terminal 400 forms a flange terminal 424 that is Y-shaped and has at least one bent portion at a distal end thereof. FIG. 4J shows another preferred embodiment of the conducting terminal 400, wherein the second end 404 of the conducting terminal 400 forms a hook terminal 426 that is a hook in shape and has an inclined opening. FIG. 4K and FIG. 4L show other preferred embodiments of the conducting terminal 400, wherein the second end 404 of the conducting terminal 400 forms a round pin terminal 428 that is an elongated round pin in shape, or an oblate pin terminal 430 that is an elongated oblate pin in shape.

In another embodiment, the present invention further provides a manufacturing method of a conducting terminal connector. The conducting terminal connector 200 is used to join a conducting terminal 400 and a conducting wire 208. The conducting wire 208 includes a conducting core 212 and an insulating cladding 210 enclosing the conducting core 212. The manufacturing method includes the steps of:

(1) providing an insulating tube 202 wherein the insulating tube is shrunken and deformed when heated to a temperature higher than a first temperature and having a melting point at a second temperature;

(2) providing a conducting terminal 400 wherein the material of the conducting terminal 400 may be brass, bronze, copper alloy, stainless steel, gold, karat gold alloy or platinum, and wherein the conducting terminal 400 includes a first end 402 accommodated in the insulating tube 202, and a second end 404 opposite to the first end 402, the second end 404 being exposed outwardly, for connecting to an external conducting contact point, the first end 402 being bent to form a longitudinal elongation 406 with an opening facing upward;

(3) providing a soldering sleeve 300 on the longitudinal elongation 406 of the conducing terminal 400, wherein the soldering sleeve 300 is made of material such as brass, bronze, copper alloy, gold, karat gold, tin, lead, nickel, silver and bismuth, and the soldering sleeve 300 has a melting point at a third temperature between the first temperature and the second temperature, and the soldering sleeve 300 is formed by a casting method to have a corrugated and seamless outer surface 308 on its outer periphery, thereby allowing the soldering sleeve 300 for receiving the insertion of the conducting core 212 of the strip-off insulating cladding 210;

(4) heating an outer part 204 of the insulating tube 202 corresponding to the soldering sleeve 300 in order to heat the insulating tube 202 to a predetermined temperature between the first temperature and the third temperature, and then an inner part 206 of the insulating tube 202 corresponding to the soldering sleeve 300 being shrunken due to the heat and thus the inner part 206 of the insulating tube 202 firmly lodging into corrugated gaps 302 of the corrugated and seamless outer surface 308 of the soldering sleeve 300, thereby forming the conducting terminal connector 200 and achieving better connector strength between the soldering sleeve 300 and the insulating tube 202.

In accordance with the aforementioned embodiment, the soldering sleeve 300 may be configured as shown in any one of FIGS. 3A, 3B and 3C.

In accordance with the aforementioned embodiment, the conducting terminal 400 may be configured as shown in any one of FIGS. 4A, 4B, 4C, 4D, 4E, 4F, 4G, 4H, 4I, 4J, 4K, and 4L.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A conducting terminal connector configured for joining a conducting terminal and at least one conducting wire, each conducting wire comprising a conducting core and an insulating cladding enclosing said conducting core, said conducting terminal connector comprising:

an insulating tube, shrunken and deformed when heated to a temperature higher than a first temperature and having a melting point at a second temperature;

a conducting terminal, including a first end accommodated in said insulating tube, and a second end opposite to said first end, said second end being exposed outwardly for connecting to an external conducting contact point, said first end being bent to form a longitudinal elongation with an opening facing upward; and a soldering sleeve, made of a material selected from the group consisting of brass, bronze, copper alloy, gold, karat gold, tin, lead, nickel, silver and bismuth, being formed by a casting method, including a corrugated and seamless outer surface on an outer periphery of said soldering sleeve, having a melting point at a third temperature between said first temperature and said second temperature, said soldering sleeve being placed on said longitudinal elongation of said conducing terminal to allow for insertion of said conducting core with said insulating cladding stripped off;

wherein When heating an outer part of said insulating tube that corresponds to said soldering sleeve to heat said insulating tube to a predetermined temperature between said first temperature and said third temperature, an inner part of said insulating tube that corresponds to said soldering sleeve is shrunken to lodge in said corrugated and seamless outer surface of said soldering sleeve, thereby forming said conducting terminal connector.

2. The conducting terminal connector according to claim 1, wherein said corrugated and seamless outer surface is wave-like.

3. The conducting terminal connector according to claim 1, wherein said corrugated and seamless outer surface is serrate.

4. The conducting terminal connector according to claim 1, wherein said soldering sleeve further comprising a corrugated and seamless inner surface on its inner periphery.

5. The conducting terminal connector according to claim 4, wherein said corrugated and seamless inner surface is wave-like.

6. The conducting terminal connector according to claim 4, wherein said corrugated and seamless inner surface is serrate.

7. The conducting terminal connector according to claim 1, wherein said soldering sleeve further comprises an extension which extending over said longitudinal elongation of said conducting terminal, said extension is provided with a radial enlargement for better insertion of said conducting core.

8. The conducting terminal connector according to claim 1, wherein said longitudinal elongation of said conducting terminal is semicircular or C-shaped.

9. A manufacturing method of a conducting terminal connector, said conducting terminal connector configured to join a conducting terminal and a conducting wire, said conducting wire comprising a conducting core and an insulating cladding enclosing said conducting core, said fabricating method comprising:

providing an insulating tube, said an insulating tube being shrunken and deformed when heated to a temperature higher than a first temperature and having a melting point at a second temperature;

providing a conducting terminal, said conducting terminal including a first end accommodated in said insulating tube, and a second end opposite to said first end, said second end being exposed outwardly for connecting to an external conducting contact point, said first end being bent to form a longitudinal elongation with an opening facing upward;

providing a soldering sleeve to be placed on said longitudinal elongation of said conducing terminal to allow for insertion of said conducting core with said insulating cladding stripped off, said soldering sleeve being made of a material selected from the group consisting of brass, bronze, copper alloy, gold, karat gold, tin, lead, nickel, silver and bismuth, said soldering sleeve being formed by a casting method, including a corrugated and seamless outer surface on an outer periphery of said soldering sleeve, said soldering sleeve having a melting point at a third temperature between said first temperature and said second temperature; and heating an outer part of said insulating tube that corresponds to said soldering sleeve to heat said insulating tube to a predetermined temperature between said first temperature and said third temperature, an inner part of said insulating tube that corresponds to said soldering sleeve is shrunken to lodge in said outer corrugated surface of said soldering sleeve, thereby forming said conducting terminal connector.

10. The manufacturing method of a conducting terminal connector according to claim 9, wherein said corrugated and seamless outer surface is wave-like.

11. The manufacturing method of a conducting terminal connector according to claim 9, wherein said corrugated and seamless outer surface is serrate.

12. The manufacturing method of a conducting terminal connector according to claim 9, wherein said soldering sleeve further comprising a corrugated and seamless inner surface on its inner periphery.

13. The manufacturing method of a conducting terminal connector according to claim 12, wherein said corrugated and seamless inner surface is wave-like.

14. The manufacturing method of a conducting terminal connector according to claim 12, wherein said corrugated and seamless inner surface is serrate.

15. The manufacturing method of a conducting terminal connector according to claim 9, wherein said soldering sleeve further comprises an extension which extending over said longitudinal elongation of said conducting terminal, said extension is provided with a radial enlargement for better insertion of said conducting core.

16. The manufacturing method of a conducting terminal connector according to claim 9, wherein said longitudinal elongation of said conducting terminal is semicircular or C-shaped.

* * * * *